US007669818B2

(12) United States Patent
Prime

(10) Patent No.: US 7,669,818 B2
(45) Date of Patent: Mar. 2, 2010

(54) STAY 'N PLAY CHILDREN'S TOY RESTRAINT

(76) Inventor: Tiffany M. Prime, 8 Cliffwood Dr., Neptune, NJ (US) 07753

( * ) Notice: Subject to any disclaimer, the term of this patent is extended or adjusted under 35 U.S.C. 154(b) by 711 days.

(21) Appl. No.: 11/546,854

(22) Filed: Oct. 13, 2006

(65) Prior Publication Data

US 2007/0187560 A1 Aug. 16, 2007

Related U.S. Application Data

(60) Provisional application No. 60/771,210, filed on Feb. 8, 2006.

(51) Int. Cl.
*A44B 1/18* (2006.01)

(52) U.S. Cl. ..... 248/205.2; 248/229.23

(58) Field of Classification Search ..... 248/205.2, 248/104, 226.11, 29.23; 24/298, 300–302
See application file for complete search history.

(56) References Cited

U.S. PATENT DOCUMENTS 4,114,847 A * 9/1978 Bogensberger ..... 248/104
4,989,811 A * 2/1991 Millis et al. ..... 248/104
5,016,845 A * 5/1991 Pellegrino ..... 248/104
6,250,592 B1 * 6/2001 Davis ..... 248/104
6,971,612 B1 * 12/2005 Wilson-Lowery ..... 248/104
7,472,871 B1 * 1/2009 Demontegnac ..... 248/104
2003/0205650 A1 * 11/2003 Lale ..... 248/205.2
2003/0218105 A1 * 11/2003 Sones et al. ..... 248/104
2007/0012822 A1 * 1/2007 Bellamy-Noseworthy et al. ..... 248/104

* cited by examiner

*Primary Examiner*—Ramon O Ramirez
(74) *Attorney, Agent, or Firm*—Charles Brodsky

(57) ABSTRACT

The invention employs a clamp securable to a baby carriage, highchair, stroller, car seat, table or baby carrier, attached to one end of a tether of a length short enough so that the tether cannot accidently wrap around an infant's or child's head, whose opposite end employs a hook-and-loop adhesive strap of a length long enough to allow wrapping around the toy whose falling is to be restrained, or inserted through various openings of the toy to prevent it from falling to the floor or ground.

11 Claims, 1 Drawing Sheet

STAY 'N PLAY CHILDREN'S TOY RESTRAINT

CROSS-REFERENCE TO RELATED APPLICATIONS

A Provisional Patent Application covering the invention described herein was filed Feb. 8, 2006, and assigned Ser. No. 60/771,210.

STATEMENT REGARDING FEDERALLY SPONSORED RESEARCH OR DEVELOPMENT

Research and development of this invention and Application have not been federally sponsored, and no rights are given under any Federal program.

REFERENCE TO A MICROFICHE APPENDIX

Not Applicable

BACKGROUND OF THE INVENTION

1. Field of the Invention

This invention relates to infant and young children's toys and, more particularly, to a restraint device which prevents the toy from being inadvertently knocked to the ground in play.

2. Description of the Related Art

As will be understood, infants in baby carriers, and young children in the formative years sitting in highchairs, strollers and car seats, oftentimes bang and thrash their hands about—pushing dropping, or throwing their toys to the floor or ground. While advances in materials technologies have gone a long ways in preventing cracking or other damaging of the toys upon impact, the fact remains that no matter how protective these manufactures may be, the fall to the floor or ground results in the toy itself becoming dirty and/or hygienically unclean—no small matter to a mother, grandparent or nanny possessed of germophobic concerns. In those situations, it is not unusual to then find the caregiver picking up the fallen toy, placing it into a diaper bag or other carrying container, and bringing it back home to wash and clean it before allowing the infant or young child to play with it again. As anyone who has cared for an infant or young child of this type can attest, any depriving of the infant or child of its then favorite toy can easily result in crying, screaming and shrieking by it in striving to get the toy back.

OBJECTS OF THE PRESENT INVENTION

It is an object of the present invention, therefore, to provide a restraint device which prevents the toy from being inadvertently knocked to the ground during play.

It is an object of the present invention, also, to provide such a restraint device which can easily be installed for use, and removed for storage.

It is a further object of the invention to provide such a restraint which is simple to utilize, while being extremely effective for its intended purpose.

SUMMARY OF THE INVENTION

As will be seen from the following description, the present invention comprises a STAY 'n PLAY child restraint device which secures the toy in question to a baby carriage, a stroller, a highchair, a car seat, a table, a baby carrier—and, generally, to wherever the infant or young child may be. As will be seen, a preferred embodiment of the invention employs a clamp attached to one end of a tether of a length short enough so that the tether cannot accidentally be wrapped around the infant or child's head to present a possibility of subsequent choking. To the other end of the tether, a VELCRO hook-and-loop interstices strap (or strip) is secured, of a length to allow the strap/strip to be wrapped around the toy whose falling is to be restrained, or inserted through various openings of the toy to hold it in place. In a preferred embodiment of the invention, a double-sided VELCRO hook-and-loop interstices adhesive is employed for this strap, with one end of it, for example, being inserted within a tube-like tether and there held permanently in place by a sewing or adhesive action. The other end of the VELCRO strap can then be fitted through, or wrapped around, the toy as the case may be to hold it in position.

In accordance with the invention, the opposite end of the tether is secured to any type of clamp, which can then be releasably attached to a flat surface of the baby carriage, the highchair, the stroller, the car seat, the table, the baby carrier—or wherever the infant or young child is positioned. Once clamped in place in this manner, any pushing or throwing action which might otherwise result in the toy falling to the floor is prevented by the combined action of the wrap-around VELCRO, the tether and the clamp.

As will be appreciated by those skilled in the art, a wide variety of clamps may be used for securing the tether fast to the baby carriage, the stroller, the highchair, the car seat, the table, the baby carrier, etc. in this manner, to prevent the fall of the toy to the floor.

BRIEF DESCRIPTION OF THE DRAWING

These and other features of the present invention will be more clearly understood from a consideration of the following description, taken in connection with the single FIGURE of the drawing, in which.

DETAILED DESCRIPTION OF THE INVENTION

Figure 1:
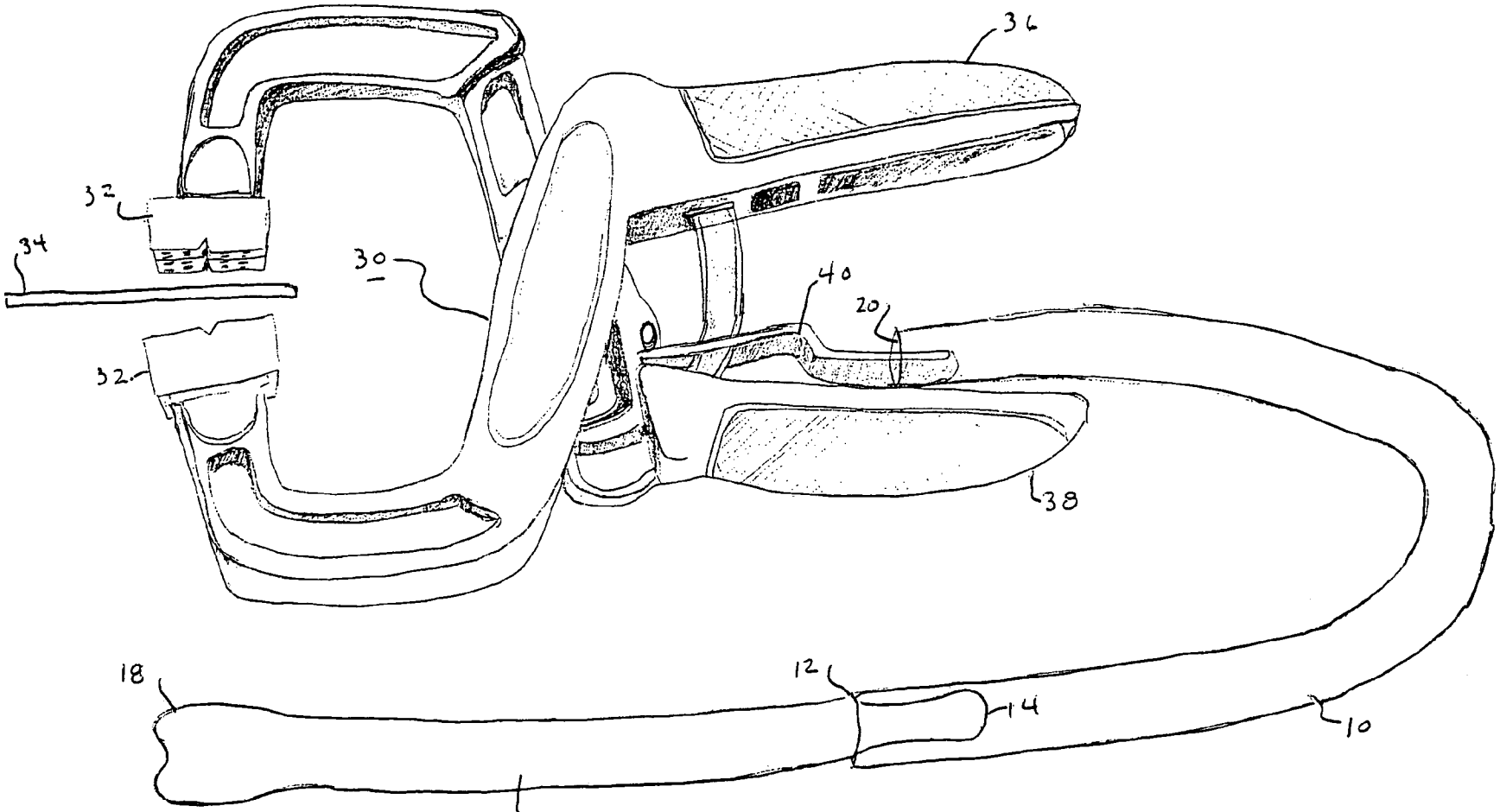
FIG. 1 is a pictorial view helpful in an understanding of the STAY 'n PLAY children's toy restraint of the invention.

In the FIG. 1 embodiment, a tube-like tether is shown at 10 having one end 12 coupled to receive a first end 14 of a double-sided VELCRO hook-and-loop interstices strap or strip 16 in a secured relationship—as by a stitching or an adhesive attachment. An opposite end 18 of the strap 16 is configured of a dimension to permit the wrapping of the strip 16 around the child's toy to be there held in place by the adhesive interstices of the VELCRO construction. (Alternatively, the dimensioning of the strap 16 may be such as to allow the end 18 to fit within rings, slots, or other components or arrangements of the toy to similarly hold the toy secure with the strap 16 and within the tether 10.)

As also illustrated in FIG. 1, the opposite end 20 of the tether 10 is fitted about, or with, a clamp 30 of conventional construction whose vertically disposed retractable jaws 32 grip to a baby carriage, highchair, stroller, car seat, table, or baby carrier surface 34 by one movement of its oppositely positioned handle grips 36, 38 in a first or latch direction, and to uncouple or unlatch from such surface by the actuation of a release clip 40 to which the tether end 20 is coupled in either detachable or fixed securement. Any type of clamp can be used according to the invention in this manner—with one particularly attractive one being that available as Click-Grip part No. 59200 of the Irwin Company of Huntersville, N.C. As will be appreciated by those skilled in the art, with the jaws 32 clamped in position, any toy coupled with the VELCRO strap/strip 16 will then be tethered fast to the clamp 30 in essentially limiting to the length of the tether 10 the distance that any toy may fall, be pushed, or be thrown by the infant or young child. It is in this manner that a restraint is provided by the STAY 'n PLAY construction of the invention to prevent the toy from falling to the floor or ground and becoming dirty as a result. As will also be appreciated, after use the tether 10 can be removed from the clip 40 at its end 20, and stored away until such later time as another toy is to be played with by the infant or young child, and desired to be stayed from falling to the floor.

And, as will be seen, actuation of the release clip 40 frees the clamp from the baby carriage, highchair, stroller, car seat, table or baby carrier surface for storage of the restraint device after use, until required once again.

While there has been described what is considered to be a preferred embodiment of the present invention, it will be readily appreciated by those skilled in the art that modifications can be made without departing from the scope of the teachings herein. For at least such reason, therefore, resort should be had to the claims appended hereto for a true understanding of the invention.

I claim:

1. The combination comprising:

a baby carriage, stroller, highchair, car seat, table or baby carrier surface:

a clamp for removably attaching to said surface, said clamp having a pair of vertically disposed retractable jaws pivotable by oppositely positioned handle grips between closed and open positions, and a releasable clip to latch said vertically disposed retractable jaws closed for attachment of said clamp to said surface and to unlatch said vertically disposed retractable jaws open for removal of paid clamp from said surface for storage of said clamp;

a child's toy; and a tether having a first end coupled with said releasable clip and an opposite second end coupled to said toy; and with the tether being of a length less than the height of said baby carriage, stroller, highchair, car seat, table or baby carrier surface above a ground surface beneath it;

whereby said clamp and said tether prevent the toy when placed on said baby carriage, stroller, highchair, car seat, table or baby carrier surface from being knocked to the ground below.

2. The combination of claim 1 wherein said second end of said tether is dimensioned to fit within individual ones of rings, slots, components and arrangements of the child's toy desired to be restrained from being knocked to the around surface below.

3. The combination of claim 1 wherein said second end of said tether is dimensioned to wrap around the child's toy desired to be restrained from being knocked to the ground surface below.

4. The combination of claim 3 wherein said second end of said tether is provided with hook-and-loop adhesive interstices to restrain the child's toy from being knocked to the ground surface below.

5. The combination of claim 1 wherein said tether includes a strap of double-sided hook-and-loop interstices, a first end of which is fitted within a tube coupled with said release clip, and a second end of which is dimensioned to fit within individual ones of rings, slots, components and arrangements of the child's toy desired to be restrained from being knocked to the ground surface below.

6. The combination of claim 5 wherein said strap is secured within said tube by one of a stitching and adhesive attachment.

7. The combination of claim 5 wherein said tether is also of a length short enough so that the tether cannot accidentally be wrapped around the infant or child's head.

8. The combination of claim 1 wherein said tether includes a strap of double-sided hook-and-loop interstices, a first end of which is fitted within a tube coupled with said release clip, and a second end of which is dimensioned to wrap around the child's toy desired to be restrained from being knocked to the ground surface below.

9. The combination of claim 8 wherein said strap is secured within said tube by one of a stitching and adhesive attachment.

10. The combination of claim 8 wherein said tether is also of a length short enough so that the tether cannot accidentally be wrapped around the infant or child's head.

11. The combination of claim 1 wherein said tether is also of a length short enough so that the tether cannot accidentally be wrapped around the infant or child's head.

* * * * *